US011653730B2

(12) United States Patent
Meyer et al.

(10) Patent No.: US 11,653,730 B2
(45) Date of Patent: May 23, 2023

(54) COLLAPSIBLE LUGGAGE

(71) Applicant: Osprey Packs, Inc., Cortez, CO (US)

(72) Inventors: Michael J. Meyer, Highlands Ranch, CO (US); Hanh Doan, Ho Chi Minh (VN); James J. Matthews, Erie, CO (US)

(73) Assignee: Osprey Packs, Inc., Cortez, CO (US)

( * ) Notice: Subject to any disclaimer, the term of this patent is extended or adjusted under 35 U.S.C. 154(b) by 21 days.

(21) Appl. No.: 17/376,717

(22) Filed: Jul. 15, 2021

(65) Prior Publication Data

US 2022/0022614 A1 Jan. 27, 2022

Related U.S. Application Data

(60) Provisional application No. 63/054,593, filed on Jul. 21, 2020.

(51) Int. Cl.

| | |
|---|---|
| ***A45C 7/00*** | (2006.01) |
| ***A45C 9/00*** | (2006.01) |
| ***A45C 13/00*** | (2006.01) |
| ***A45C 13/04*** | (2006.01) |
| ***A45C 13/10*** | (2006.01) |

(52) U.S. Cl.

CPC ..... *A45C 7/0077* (2013.01); *A45C 9/00* (2013.01); *A45C 13/005* (2013.01); *A45C 13/04* (2013.01); *A45C 13/10* (2013.01); *A45C 2013/1015* (2013.01)

(58) Field of Classification Search

CPC ..... A45C 7/0077; A45C 9/00; A45C 13/005; A45C 13/04; A45C 13/10; A45C 2013/1015

See application file for complete search history.

(56) References Cited

U.S. PATENT DOCUMENTS

| | | | | |
|---|---|---|---|---|
| 6,443,274 | B1 * | 9/2002 | Klamm | A45C 7/0077 190/127 |
| 7,500,547 | B2 * | 3/2009 | Bettua | A45C 7/0036 190/114 |
| 7,534,041 | B2 * | 5/2009 | Godshaw | B25H 3/00 383/121.1 |

(Continued)

FOREIGN PATENT DOCUMENTS

| | | | | |
|---|---|---|---|---|
| FR | 2567471 | A1 | 1/1986 | |
| WO | 2007074973 | A1 | 7/2007 | |
| WO | WO-2013028974 | A2 * | 2/2013 | A45C 13/007 |

OTHER PUBLICATIONS

European Patent Application No. 21186635.5, Extended European Search Report, dated Dec. 7, 2021, 8 pages.

*Primary Examiner* — Jennifer Robertson
*Assistant Examiner* — Justin Caudill
(74) *Attorney, Agent, or Firm* — Rankin, Hill & Clark LLP

(57) ABSTRACT

Luggage or apparatus for carrying items where a frame member collapses to allow the front to collapse toward the back to reduce the volume of the apparatus for shipping or storage. The frame member may extend: across the left side, along the bottom, from the left side to the right side, across the right side, from the back to the front, or a combination thereof. The bottom may include a folding bottom board attached with a fabric hinge. Shoulder straps may be stored in a front compartment to carry the apparatus as a backpack.

16 Claims, 13 Drawing Sheets

(56) References Cited

U.S. PATENT DOCUMENTS

| | | | | |
|---|---|---|---|---|
| 2002/0125089 | A1* | 9/2002 | Davis | A45C 7/0077 190/115 |
| 2004/0007433 | A1* | 1/2004 | Godshaw | A45C 7/0054 190/110 |
| 2004/0065518 | A1* | 4/2004 | Hoberman | A45C 13/385 190/115 |
| 2005/0034947 | A1 | 2/2005 | Nykoluk | |
| 2005/0051404 | A1* | 3/2005 | Chi | A45C 7/0036 190/107 |
| 2011/0083933 | A1 | 4/2011 | Engel | |
| 2013/0240314 | A1 | 9/2013 | Pitchforth | |
| 2017/0042301 | A1* | 2/2017 | Armani | A45C 7/0036 |

* cited by examiner

COLLAPSIBLE LUGGAGE

CROSS-REFERENCE TO RELATED APPLICATION

This application claims priority to and benefit of U.S. Provisional Application No. 63/054,593, filed Jul. 21, 2020, which is hereby incorporated by reference in its entirety.

FIELD THE INVENTION

Various embodiments of this invention relate to luggage, for example, used to carry items while traveling. Specific embodiments are collapsible, for example, to save space during shipping or storage. Certain embodiments can be carried on a user's back, for example, as a backpack.

BACKGROUND OF THE INVENTION

Luggage has been designed and used to save space during shipping or storage. Backpacks have been used to carry items on a user's back.

Room for improvement exists over the prior art, however, in these areas including in the design and manufacture of luggage used for travel and in the design and manufacture of luggage that is collapsible, convenient, easy to use, sturdy, long lasting, durable, versatile, and inexpensive to manufacture. Needs or potential areas for benefit exist in these areas individually as well as in various combinations of these areas, as further examples. Moreover, room for improvement exists over the prior art in the use of various components and structure used in luggage. Potential for benefit or improvement exists in these and other areas that may be apparent to a person of skill in the art having studied this document.

SUMMARY OF PARTICULAR EMBODIMENTS OF THE INVENTION

Various embodiments are or include apparatuses such as luggage, for example, used to carry items, for instance, while traveling. Various embodiments are collapsible, for example, to save space during shipping, storage, or both. Particular embodiments have wheels for rolling, can be carried on a user's back, or both. Various embodiments provide collapsibility while also being convenient and easy to use, sturdy, long lasting, durable, versatile, and inexpensive to manufacture. Various embodiments are described herein as examples, and other various benefits of certain embodiments are described herein or may be apparent to a person of skill in this area of technology.

BRIEF DESCRIPTION OF THE DRAWINGS

Non-limiting and non-exhaustive embodiments of the present technology, including the preferred embodiment, are described with reference to the following figures, wherein like reference numerals refer to like parts throughout the various views unless otherwise specified.

DETAILED DESCRIPTION OF EXAMPLES OF EMBODIMENTS

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to a carry-on luggage bag for travel by airplane. However, the technology described herein may be used with applications other than those specifically described herein. For example, the technology of the present application may be applicable to any apparatus that is collapsible, such as a backpack, a duffle bag, a container box, or the like. Moreover, the technology of the present application will be described in relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
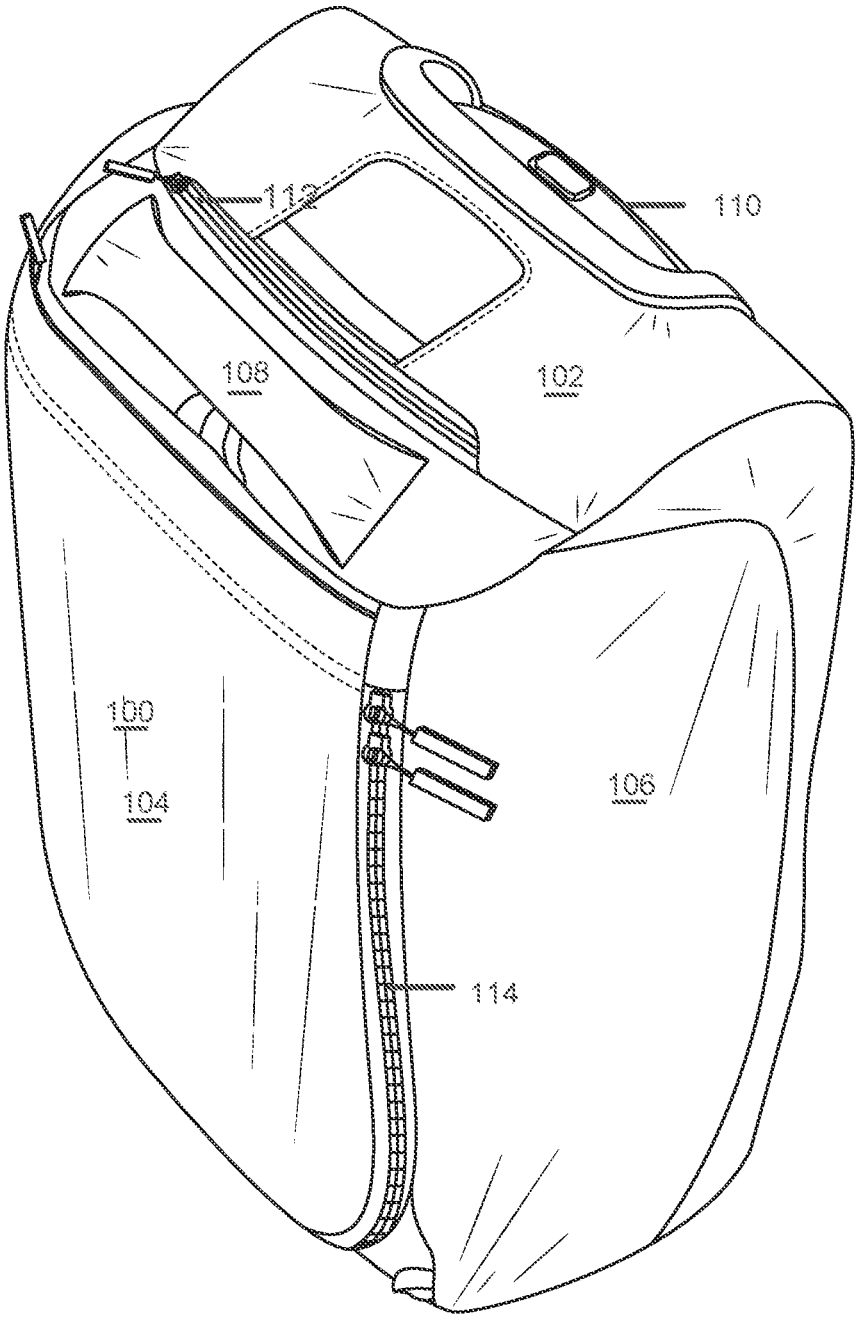
FIG. 1 is a front, top perspective view of an apparatus consistent with the technology of the present application.

FIG. 1 shows a front, top perspective view of an apparatus 100 for carrying items, the apparatus 100 being a piece of carry-on luggage 100 for illustration. The apparatus 100 includes the top panel 102, the front panel 104, and the right side panel 106 of the apparatus 100, all of which are shown. The apparatus 100 is shown standing upright and balanced with the bottom of the apparatus 100 on a flat level surface with the frame member (described below and not shown in this view) expanded away from the back to increase an interior volume of the apparatus 100 while the apparatus 100 is being used for carrying the items. The apparatus 100 may include a top handle 108; a telescoping handle 110 (i.e., fully retracted into the back); a first closure device 112, such as a zipper, for a compartment in the top for storage of items (which compartment is explained further below); and a second closure device 114, such as a zipper.

Figure 2:
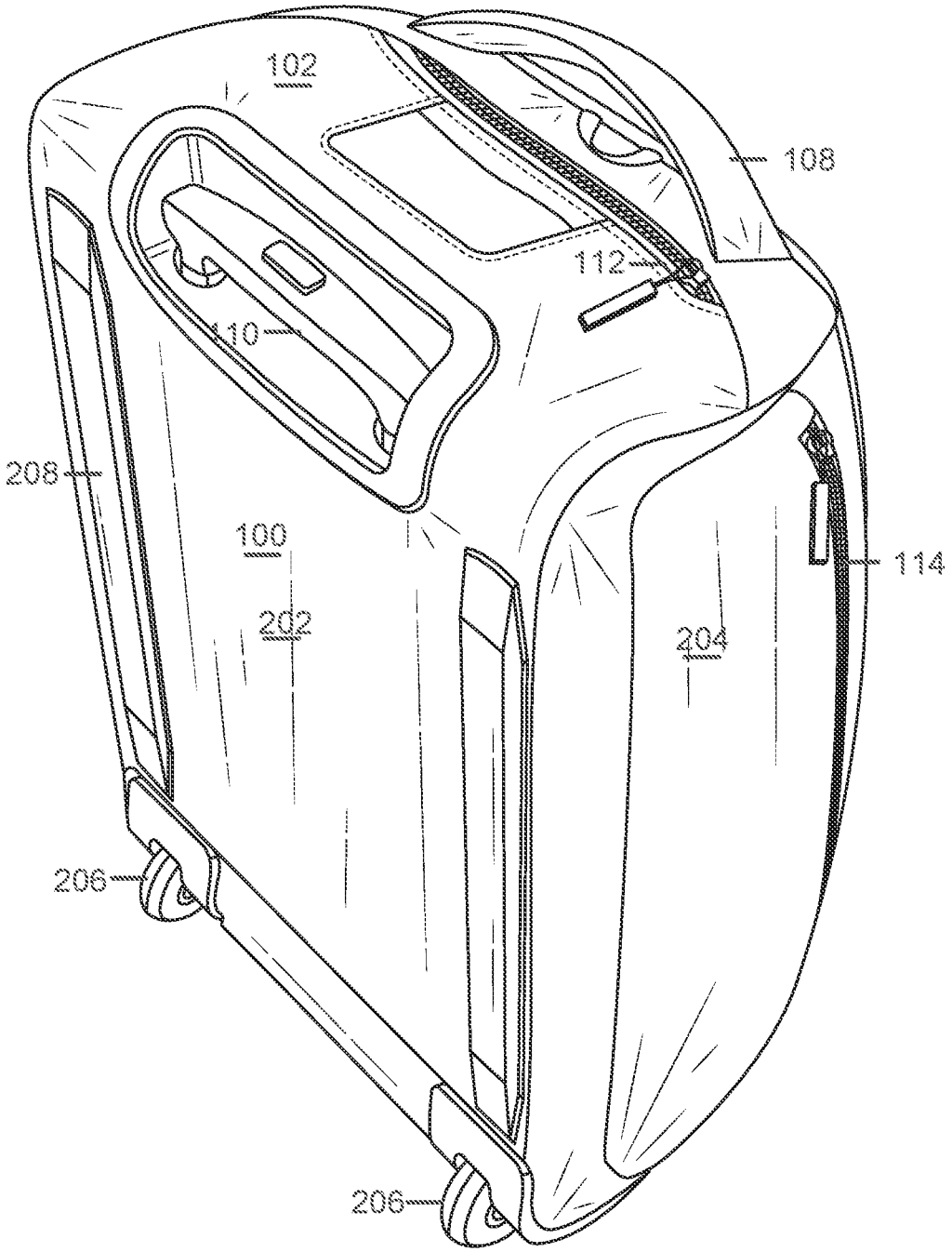
FIG. 2 is a back, top perspective view of an apparatus consistent with the technology of the present application.

FIG. 2 is a back, top perspective view of the apparatus 100 of FIG. 1 showing the top panel 102, back panel 202, and left side panel 204. FIG. 2 also shows the top handle 108, the telescoping handle 110 (i.e., fully retracted into the back), the first closure device 112 for the compartment in the top for storage of items, the second closure device 114, and two wheels 206. The back panel 202 may include a pair of slides 208. In this view, as in FIG. 1, the apparatus 100 is standing upright and balanced on the bottom of the apparatus 100 on the two wheels 206 and on the frame member (not shown in this view) on the flat level surface with the frame member expanded away from the back to increase the interior volume of the apparatus 100 while the apparatus 100 is being used.

Figure 3:
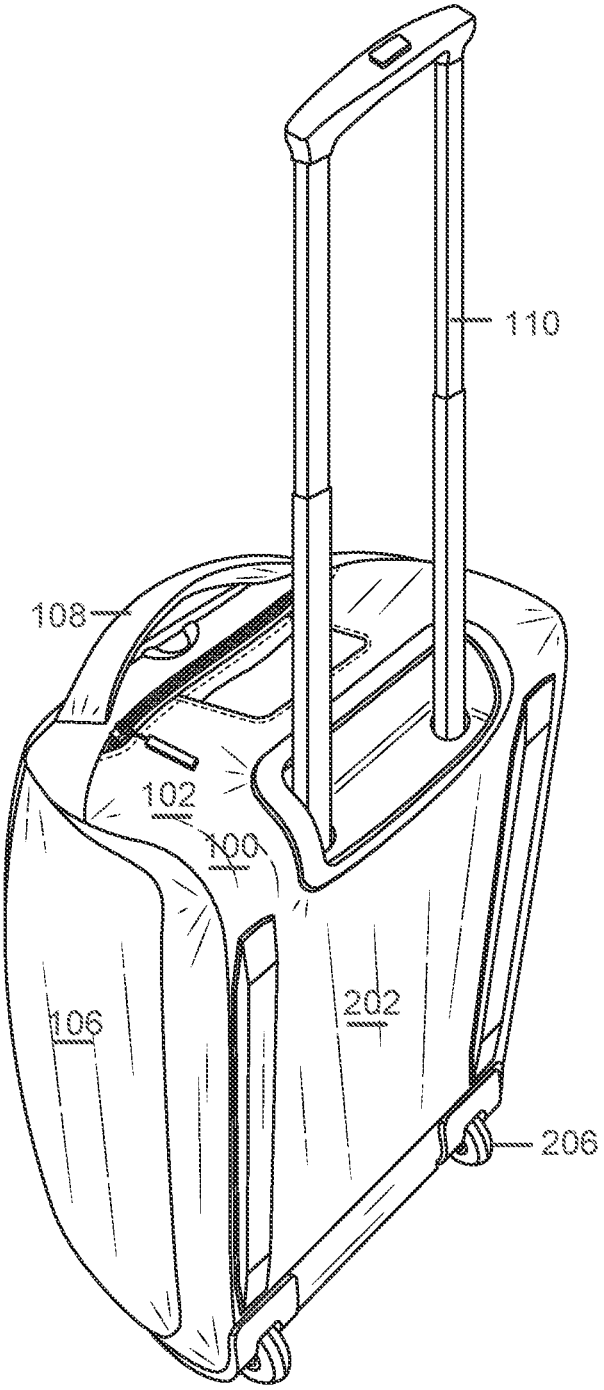
FIG. 3 is another back, top perspective view of an apparatus consistent with the technology of the present application.

FIG. 3 is another back, top perspective view of the apparatus 100 with the frame member (not shown in FIG. 3) expanded away from the back to increase the interior volume of the apparatus 100 while the apparatus is being used. The telescoping handle 110 is shown fully extended.

Figure 4:
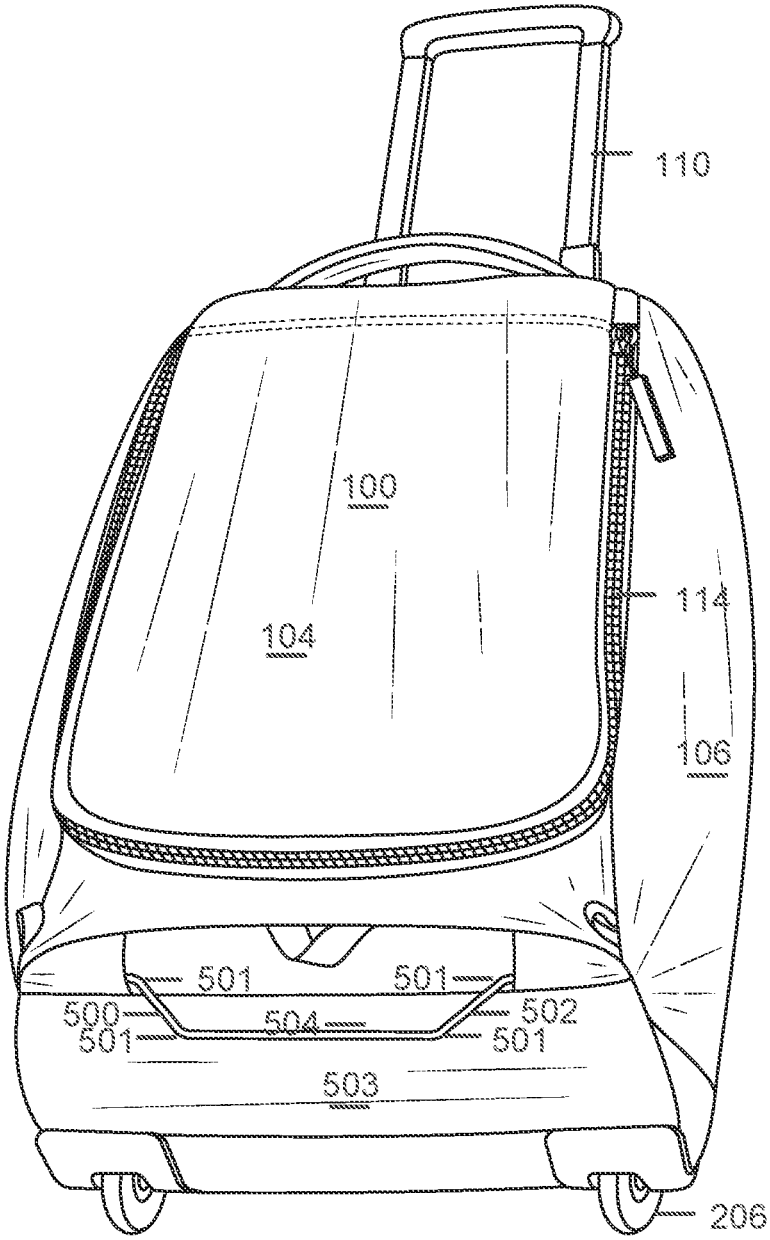
FIG. 4 is a front, bottom perspective view of an apparatus consistent with the technology of the present application.

FIG. 4 is a bottom, front perspective view of the apparatus 100 also with the telescoping handle 110 fully extended and a foot portion 502 of a frame member 500. The frame member 500, explained further below, is expanded away from the back to increase the volume of the apparatus 100 while the apparatus 100 is being used. The foot portion 502 of the frame member 500 serves, in this example, as a bottom handle and as a foot or counterbalance for the apparatus 100 such that when balanced on the wheels 206, the front weight of the apparatus is borne by the foot portion 502. The foot portion 502 may be referred to as a descending foot portion 502 as it descends below the bottom panel 503 and/or below the remaining portion of the frame member 500 to form a foot or counterbalance. The foot portion 502 of the frame member 500 is shown having a trapezoidal shape and contains four "bottom bends" 501. The bends 501 are configured to allow the frame member 500 to extend below the bottom panel 503 to provide a weight bearing foot 504. Generally, the top, front, and side panels are fabric in this exemplary embodiment. The bottom panel 503, however, may be a plastic curved substantially rigid bottom member, such as a pan or the like, that forms part of the bottom at the intersection of the back and the bottom, and the two wheels. Also visible in this view are loops of webbing that serve as exterior connection points for attachment of the shoulder straps (shoulder straps not shown in this view).

Figure 5:
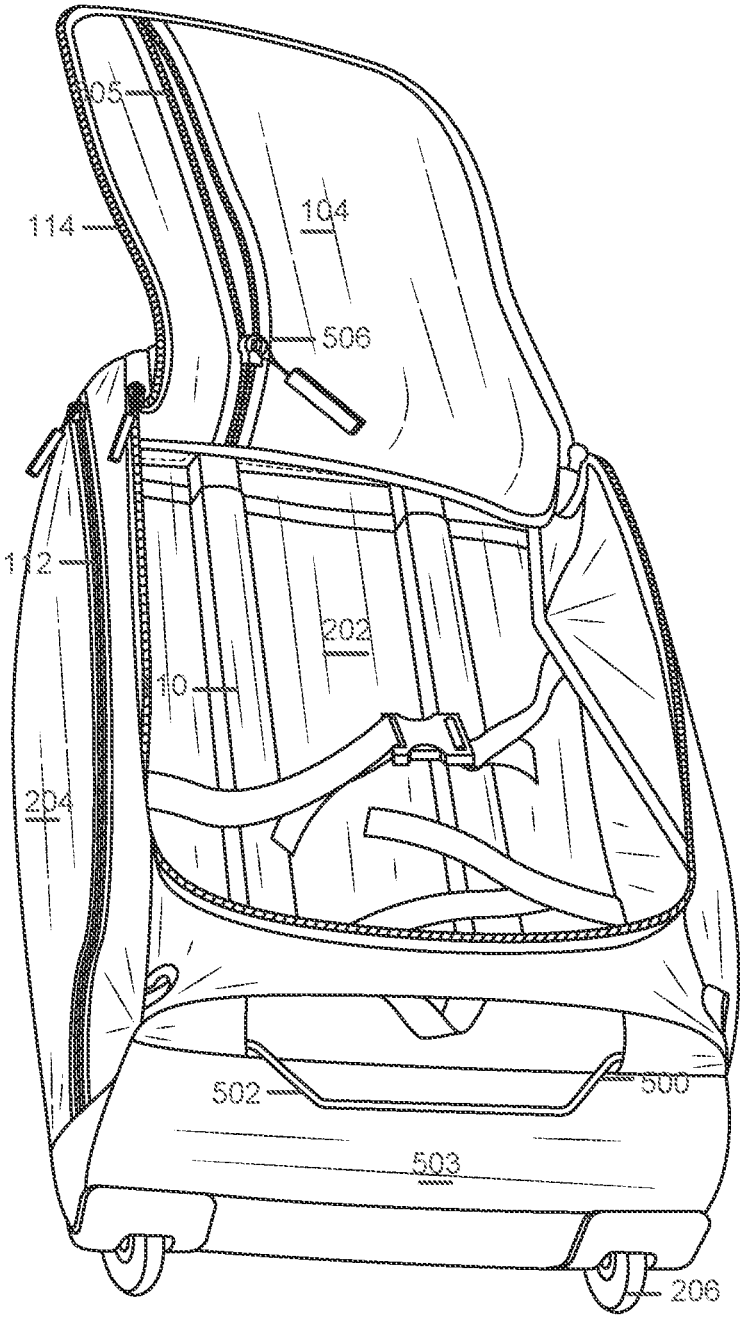
FIG. 5 is another front, bottom perspective view of an apparatus consistent with the technology of the present application.

FIG. 5 is another bottom, front perspective of the apparatus 100 of FIGS. 1 to 4 showing the bottom panel 503, the front panel 104, and the left side panel 204 with the apparatus 100 placed on the rails 208 (see FIG. 2), its back with the frame member 500 expanded away from the back to increase the interior volume of the apparatus 100. FIG. 5 shows the second closure device 114 open (or unzippered in this case), the front panel 104 is pulled open, and the items removed. The apparatus 100 includes the foot portion 502 of the frame member 500. In this exemplary embodiment, the bottom panel 503 is formed from a pan comprising the curved substantially rigid bottom member that forms part of the bottom at the intersection of the back and the bottom, the two wheels 206, and the loops of webbing for attachment of the shoulder straps (shoulder straps not shown in this view). The back panel 202 provides for the telescoping handle 110. A compartment 505 is on the inside of the front for separate storage of some of the items. The compartment 505 is formed by a space between two plies of fabric on the front panel 104. The compartment is accessed by a third closure device 506, such as the zipper shown.

Figure 6:
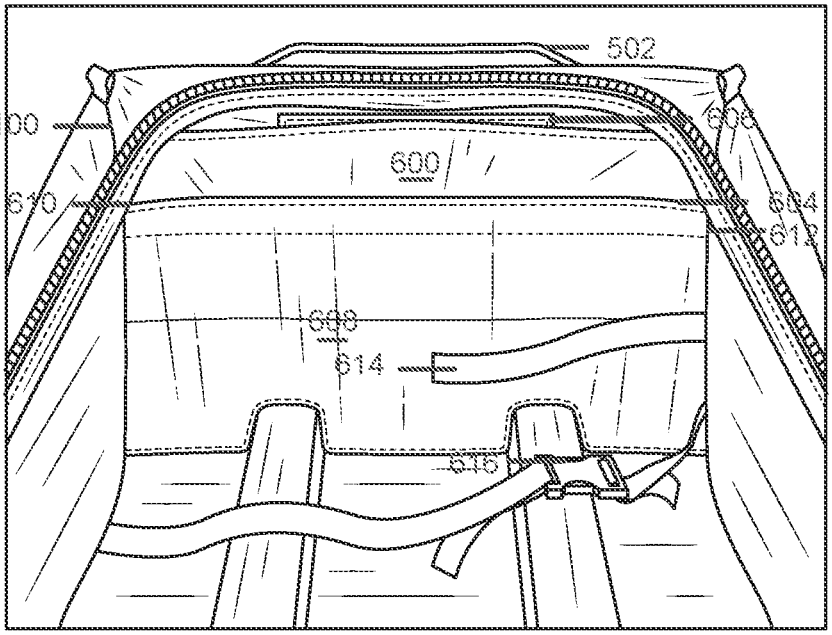
FIG. 6 is a top down view of a bottom interior panel of the apparatus shown in FIGS. 1-5.

FIG. 6 is a view from the top of the bottom panel 503 on the inside of part of the apparatus 100 of FIGS. 1 to 5. The frame member 500 is expanded away from the back to increase the interior volume of the apparatus 100. As in FIG. 5, the second closure device 114 is open (or unzippered in this example), and the front has been pulled open. The bottom panel 503 includes a first fabric cover 600 that covers a substantially rigid folding bottom board 602 (see FIG. 7) that is attached to a remainder of the bottom panel 503 with a fabric hinge 604. A first releasable hook and loop fastener 606 (partially visible in this view behind the folding bottom board) also attaches the folding bottom board to the remainder of the bottom. The front edge of the folding bottom board 602, when unfolded, is proximal the intersection of the front panel 104 and the bottom panel 503 as shown in FIG. 6. The bottom panel 503 also includes a second fabric cover 608 that forms part of the bottom at the intersection of the back and the bottom. The second cover 608 has a front edge 610 releasably attached at the front with a second releasable hook and loop fastener 612. The apparatus 100 includes straps 614, which may include a plurality of straps releasably coupled with a buckle 616 as shown, for securing the items within the apparatus 100 (i.e., a bottom one of two straps also visible in FIG. 5).

Figure 7:
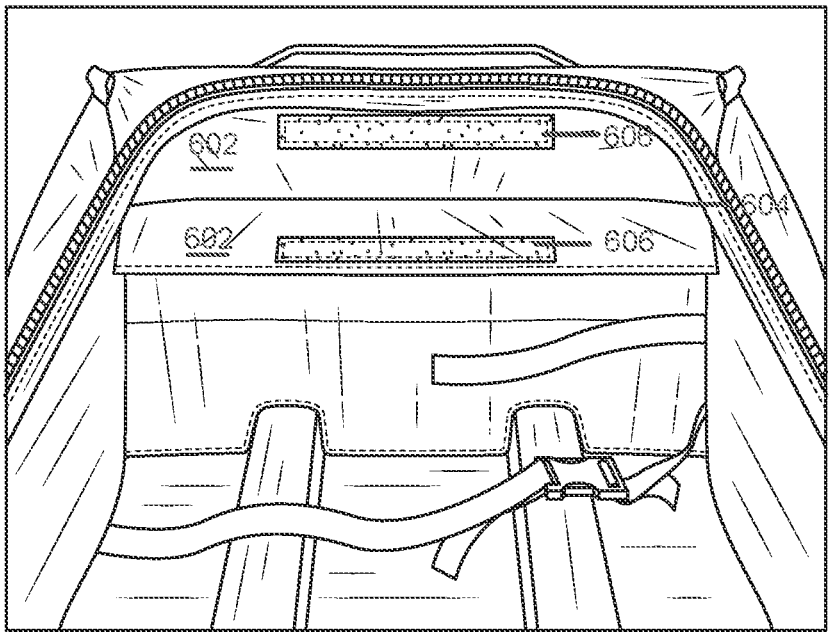
FIG. 7 is another top down view of a bottom interior panel of the apparatus shown in FIGS. 1-5.

FIG. 7 is a view, similar to FIG. 6, of the same part of the same apparatus 100. The first releasable hook and loop fastener 606 has been released, and the folding bottom board 602 has been folded, lifted, or pivoted about the fabric hinge 604. When folded, the front edge of the folding bottom board 602 is distal (or removed from) the intersection of the front panel 104 and the bottom panel 503 as shown in FIG. 7. Pivoting the substantially rigid folding bottom board 602 from its position in FIG. 6 allows the bottom panel 503 to collapse, which allows the front panel 104 to move toward the back panel 202 to reduce volume of the apparatus 100 (e.g., for shipping, storage, or both).

Figure 8:
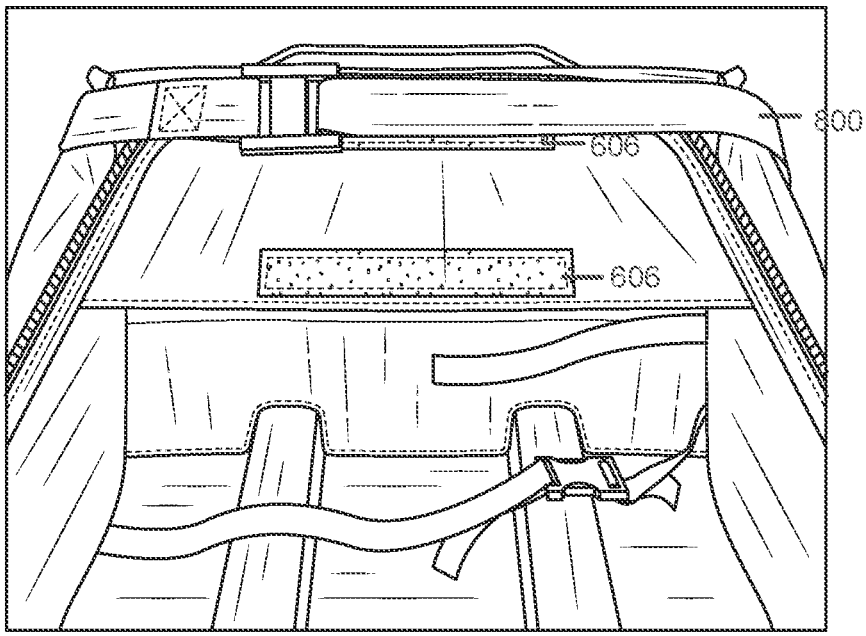
FIG. 8 is another top down view of a bottom interior panel of the apparatus shown in FIGS. 1-5.

FIG. 8 is another view similar to the views of FIGS. 6 and 7, where like parts will not be reidentified. As shown in FIG. 8, the apparatus 100 has been collapsed, at least in part, and a cam strap 800, which is shown near the bottom panel 202, is holding the frame member 500 (not visible in FIG. 8) collapsed toward the back panel 202 at the bottom, which reduces the interior volume of the apparatus 100, which may be useful for shipping or storage. As in FIG. 7, the first releasable hook and loop fastener 606 has been released to allow the substantially rigid folding bottom board 602 to be folded, lifted, or pivoted. The front edge of the folding bottom board 602 is still distal the intersection of the front panel 104 and the bottom panel 503. While shown as a cam strap 800, any suitable compression device may be used, such as an elastic cord or the like.

Figure 9:
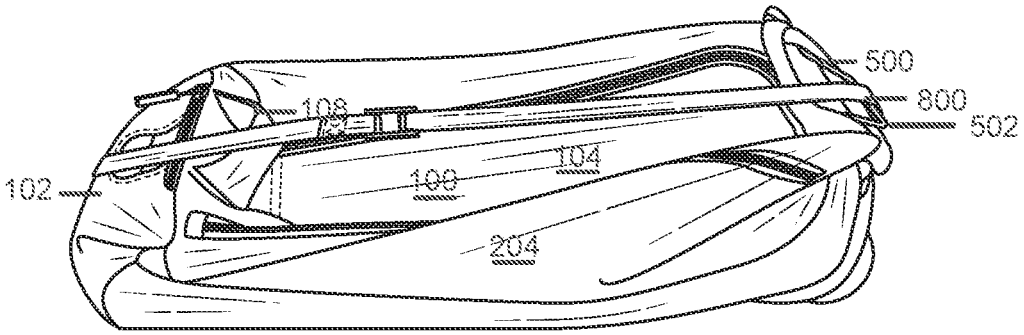
FIG. 9 is a perspective view of the apparatus shown in FIGS. 1-5 collapsed consistent with the technology of the present application.

FIG. 9 is a perspective view of the left side of the apparatus 100 collapsed. While not required, a cam strap 800 may be used to hold the frame member 500 collapsed toward the back at the bottom and the front collapsed toward the back to reduce interior volume of the apparatus 100, such as may be useful for shipping or storage. Compression members other than a cam strap 800 are possible. In FIG. 9, the second closure device 114 is closed. The left side panel 204 and the front panel 104 are visible, and the top panel 102 and top handle 108 are collapsed in this view. The frame member 500, which will be explained below, may be biased to the expanded state, away from the back, when compressive pressure is removed.

Figure 10:
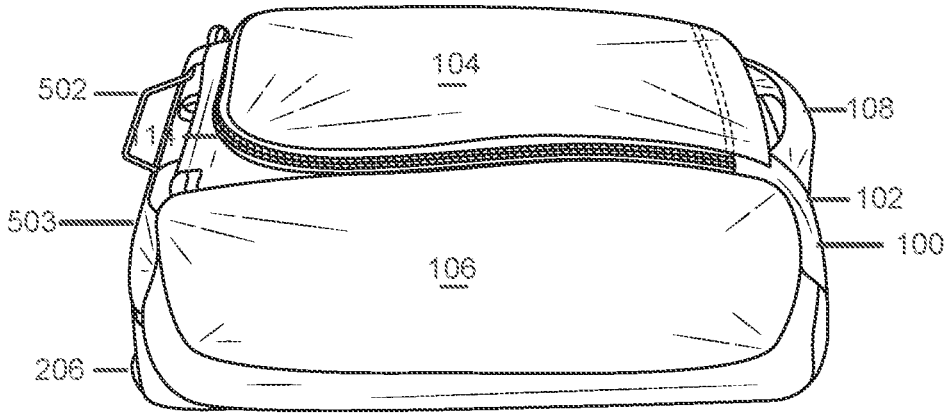
FIG. 10 is a perspective view of the apparatus in FIG. 9 uncollapsed.

FIG. 10 is a view of the right side of the apparatus 100 expanded, without the cam strap 800. FIG. 10 can be compared with FIG. 9 to see an example of the relative ability to collapse the apparatus 100. Of course, the actual difference in size depends on a number of design factors. (i.e., FIG. 9 compared to FIG. 10) for shipping or storage. Some parts as described above are shown in FIG. 10 for orientation. The volume may be reduced by almost any ratio. In certain embodiments, the folding bottom board 602 may allow a volumetric reduction to 50% or the overall interior volume in the normal course. Other designs may reduce the volume to between about 15% to 25% or between about 75% and 80%. In still some other embodiments, the folding bottom board 602 may have multiple folds to allow different reductions between about 15% and 80%.

Figure 11:
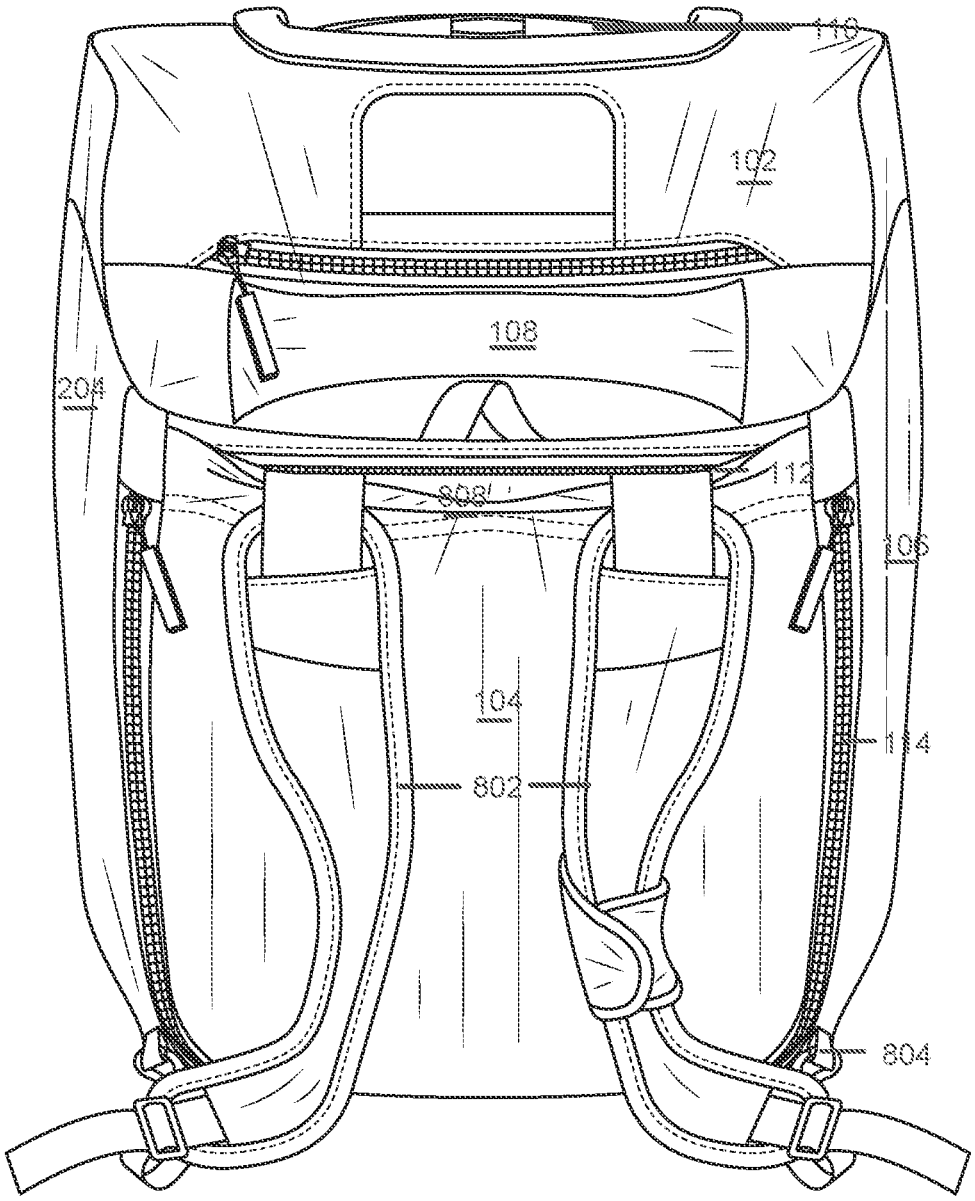
FIG. 11 is a perspective view of the apparatus shown in the above FIGS. consistent with the technology of the present application.

FIG. 11 is a front view of the apparatus 100 showing the top panel 102 and front panel 104 with the shoulder straps 802 attached to exterior connection points 804, which may be fasteners or loops of webbing as shown. Other features as described above are shown in FIG. 11 for orientation.

Figure 12:
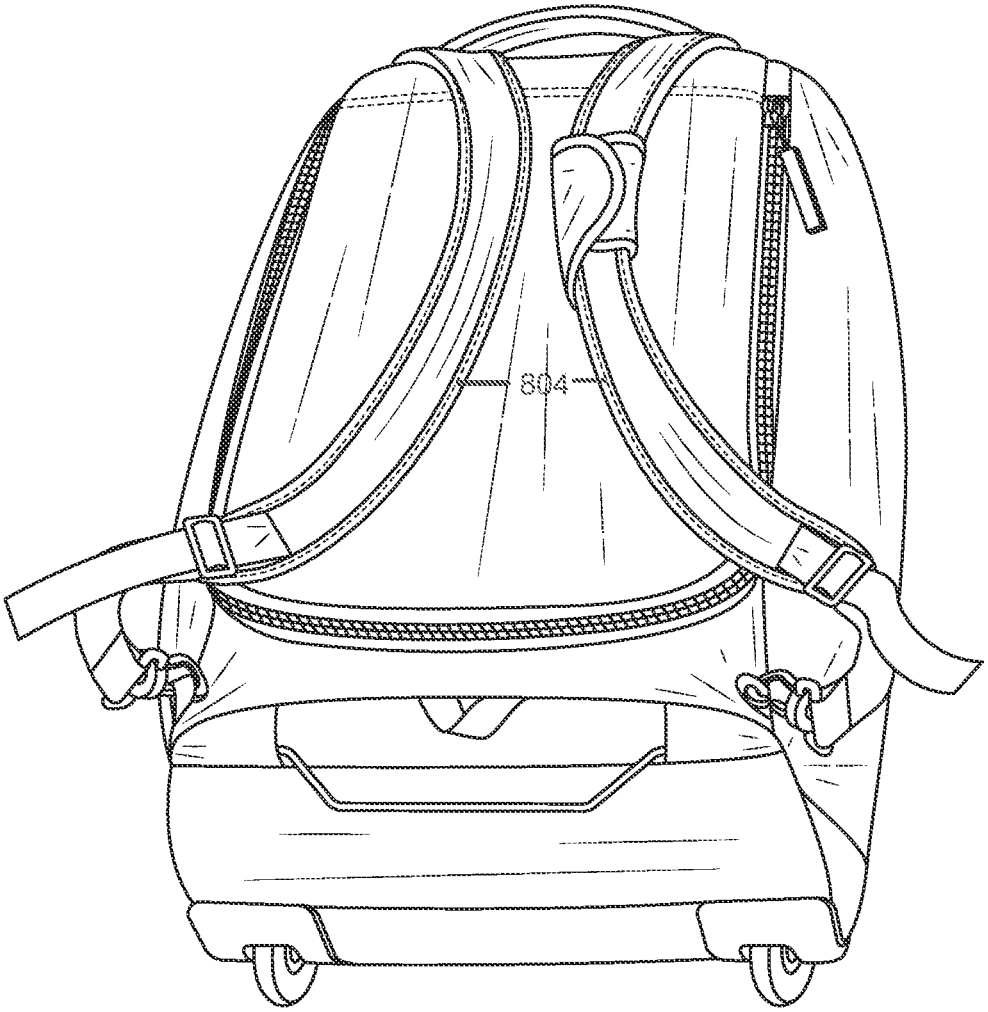
FIG. 12 is a perspective view of the apparatus of FIG. 11.

FIG. 12 is another view of the apparatus 100 with the shoulder straps 802 deployed.

Figure 13:
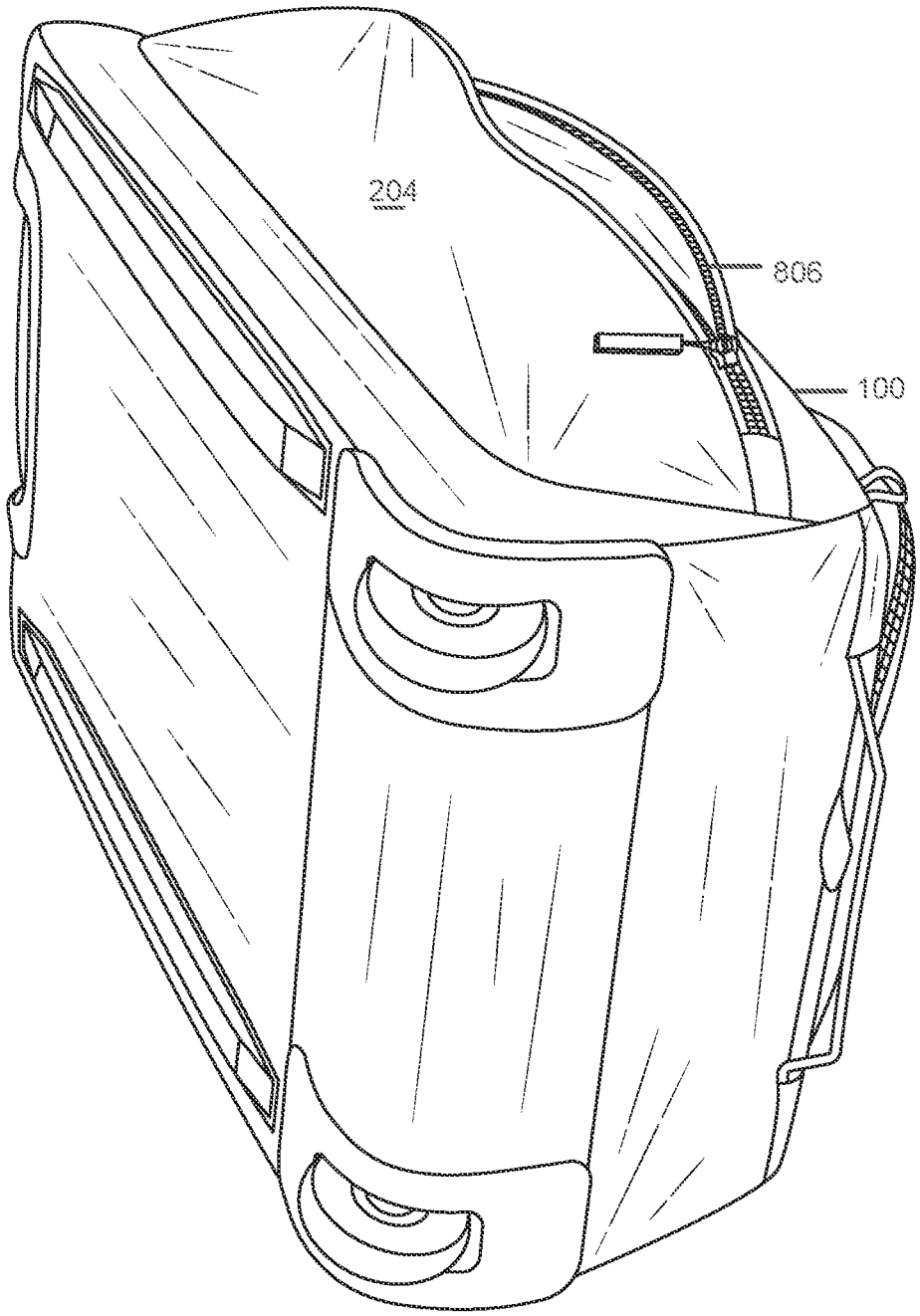
FIG. 13 is a bottom, side perspective view of the apparatus of FIGS. 1-5.
Figure 14:
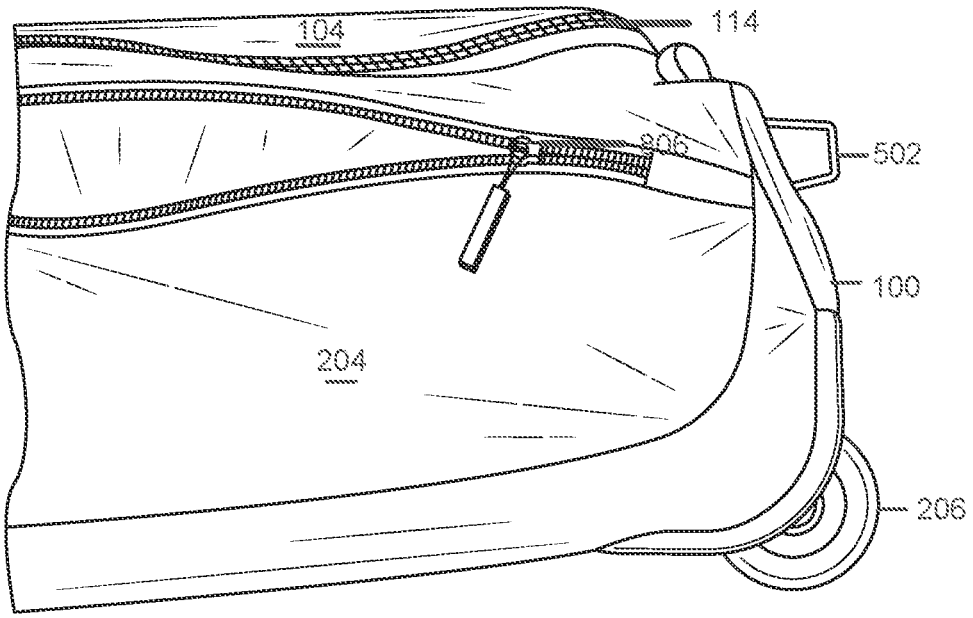
FIG. 14 is a partial side view of the apparatus of shown in the above FIGS.

FIGS. 13 and 14 are views of the apparatus 100. Apparatus 100 may include a fourth closure device 806, such as the zipper shown. The fourth closure device 806 allows access to a compartment in the left side panel 204. The compartment may be approximately the length of the apparatus 100, which may be suitable for storage of long items such as an umbrella.

Figure 15:
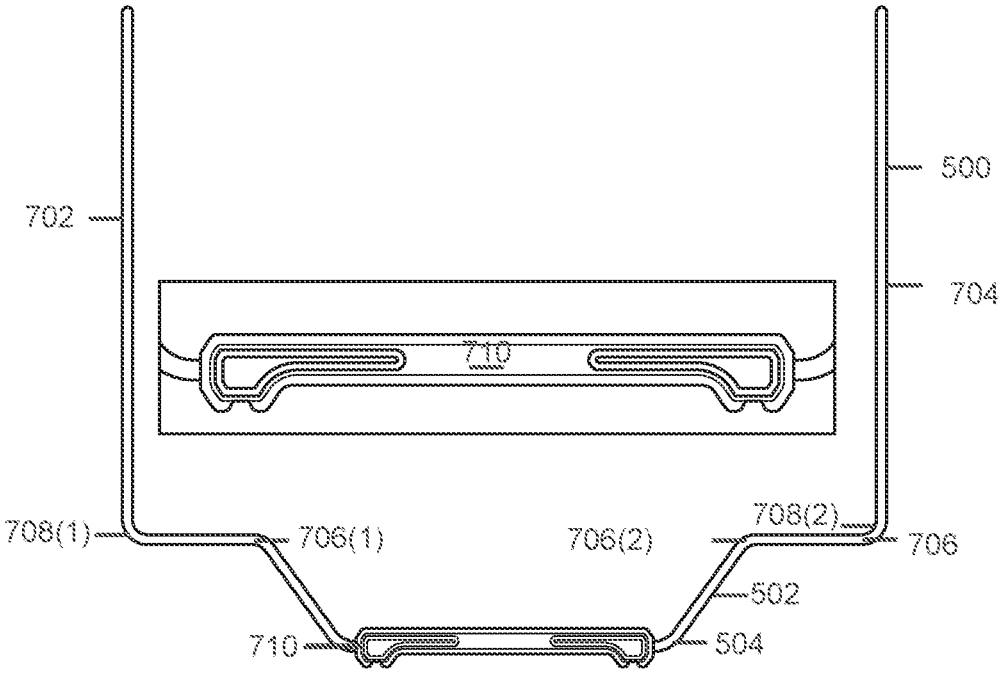
FIG. 15 is a front, elevation view of a frame member for the apparatuses shown in the above FIGS. consistent with the technology of the present application.

FIG. 15 is a front, elevation view of an example of the frame member 500 of the apparatus 100. The frame member 500 includes a left (or first) longitudinal member 702, a right (or second) longitudinal member 704, and a transverse base member 706. The traverse base member 706 has a left base portion 706(1) and a right base portion 706(2). A left bend 708(1) transitions between the left longitudinal member 702 and the left base portion 706(1), which is shown as a 90-degree bend but could be between about 75 and 105 degrees. A right bend 708(2) transitions between the right longitudinal member 702 and the right base portion 706(2), which is shown as a 90-degree bend but could be between about 75 and 105 degrees. The foot portion 502 is between the left base portion 706(1) and the right base portion 706(2), which foot portion 502 is explained above with reference to FIGS. 1-4. The weight bearing foot 504 may have a plastic part 710, which may be a snap-on part or an overmolding. Also shown is a plastic component that the frame member extends through between the bottom bends at the (e.g., bottom) handle or foot. The frame member of the apparatus and carry-on luggage of FIGS. 1 to 14 is similar to the frame member shown in FIG. 15 except without the plastic component.

Figure 16:
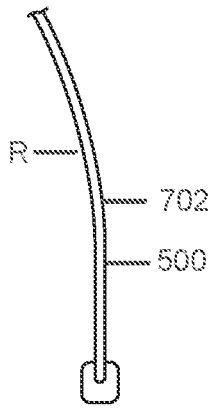
FIG. 16 is a side view of the frame member of FIG. 15.

FIG. 16 is a side view of the frame member 500 of FIG. 15. FIG. 16 illustrates, among other things, that the left longitudinal member 702 (and the right longitudinal member 704 although not shown in FIG. 16) has a radius of curvature R of an arc from the transverse base member 706. When the apparatus is uncollapsed, the left longitudinal member 702 extends from the front, left edge of the bottom panel 503 to the back, left corner, proximal the side panel 204 and back panel 202. The right longitudinal member 704 has a similar extension but converges to the right side panel 106. The radius of curvature R along the length of the left and right longitudinal members 702, 704 may be variable and have a steeper arc over portions of the members. In particular, the radius of curvature may be smaller the further along a length of the left and right longitudinal members 702, 704 where the radius of curvature decreases from the bottom panel 503 to the top panel 102.

Figure 17:
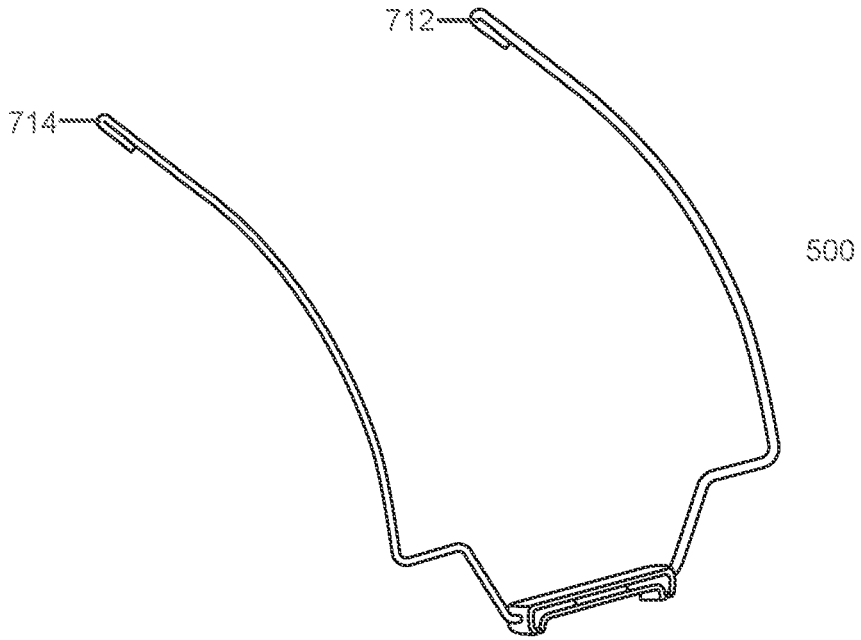
FIG. 17 is an isometric view of the frame member of FIGS. 15 and 16.

FIG. 17 is an isometric view of the frame member 500 of FIGS. 15 and 16. The frame member 500 may reside between the inner and outer plies of the left side and right side panels 204, 106 (FIGS. 1 and 2). Similarly, the transverse base member 708 may be contained, at least partially, in a sleeve or seam associated with the bottom panel 503 and the front panel 104 (FIGS. 1 and 4) The left and right longitudinal members 702, 704 may terminate at a terminal end 712 that has a bend 714, which inhibits wear on the fabric. In other embodiments, the terminal end 712 may be capped.

FIGS. 1-17 and this patent application describe, among other things, examples of certain embodiments of collapsible (having collapsed and uncollapsed configurations) apparatuses, such as, the apparatus 100 described above, which is an example of carry-on luggage. Other embodiments may differ from the particular examples described herein. Some apparatuses may be backpacks, other shipping and storage containers, child carriers, duffle bags, suitcases, or the like. In some embodiments, for example, the volume is reduced by about half. This can reduce the cost of shipping, storage, or both. The frame member 500 may extend, for example: across the left side panel 204, along the bottom panel 503 (or the front panel 104), from the left side panel 204 to the right side panel 106, across the right side panel 106, from the back panel 202 to the front panel 104 (in various embodiments at the left side panel 204, at the right side panel 106, or at both), or a combination thereof. The bottom panel 503 includes a folding bottom board 602, in some embodiments, for example, attached in certain embodiments with a fabric hinge 604. The apparatus 100 may balance, for example, on two wheels 206 and the foot portion 502 of the frame member 500. The frame member may be: steel (e.g., coated) or stainless steel, as examples. Further, the frame member 500 may be pieces coupled together, solid, monolithic, or a combination thereof. The frame member 500 may have parts that have a round cross section. The foot portion 502 of the frame member 500 may be used as a handle as well as a foot. Shoulder straps are stored in a front (e.g., zippered) compartment in some embodiments, for example, to carry the apparatus as a backpack.

Referring back to FIGS. 1-17, the apparatus 100 includes a back panel 202, a front panel 104, a bottom panel 503, a right side panel 106, a left side panel 204, and a frame member 500. The frame member 500 may be contained and move between the outer and inner plies of the panels. Still further, in various embodiments, the frame member 500 collapses, for example, toward the back panel 202, for instance, to allow the front panel 104 to collapse (e.g., toward the back panel 202), for example, to reduce volume of the apparatus 100, for instance, for shipping, storage, or both. Even further, in a number of embodiments, the frame member 500 expands away from the back panel 202, by the earlier described arc with a radius of curvature R, for example, to increase the interior volume of the apparatus 100 when the apparatus 100 is being used. As can be appreciated, increasing or decreasing the interior volume of the apparatus 100 is a relative term. As used in this application, increasing the interior volume means to increase the interior volume from the apparatus 100 in the collapsed state and decreasing the interior volume means to decrease the interior volume from the apparatus 100 in the uncollapsed state. The frame member 500 has a left longitudinal member 702 that extends across the left side panel 204, a transverse base member 706 that extends along the bottom panel 503, and a right longitudinal member 704 that extends across the right side panel 106, or a combination thereof, as examples.

As shown in FIGS. 6-8, the apparatus 100 includes a substantially rigid folding bottom board 602 that is attached to the bottom panel 503 with a fabric hinge 604. As used herein, "substantially rigid" means rigid enough to maintain its shape within ten percent of an overall dimension of the component when subjected to typical forces experienced by the component. Moreover, as used herein, plastic commonly used for the construction of luggage is considered to be substantially rigid. Fabric, on the other hand, without more, is not "substantially rigid" as used herein. The folding bottom board 602 has a first position, as shown in FIG. 6, when the apparatus 100 is in the uncollapsed configuration. The folding bottom board 602, being substantially rigid, holds the transverse base member 706 toward the front edge 610 of the folding bottom board. As shown in FIGS. 7 and 8, the folding bottom board 602 may be folded, at about the halfway point between the uncollapsed back panel 202 and front panel 104. When folded, the transverse base member 706 may be moved toward the back panel 202, which in this example reduces the interior volume by about half as the frame member 500 is moved and compressed. The compression of the frame member 500 may provide a biasing force tending to move the transverse base member 706 away from the back panel 202, which may require the use of a cam strap 800 as described above.

In a number of embodiments, the apparatus (e.g., further) includes a top panel 102. The top panel 102 extends from the back panel 202 to the front panel 104, and the top panel 102 extends from the right side panel 106 to the left side panel 204. The top panel 102 generally is made from fabric, which may be single ply, two-ply, or multiple plies. The top panel 102 in certain aspects may consist essentially of fabric but include some other elements such as rigid plastics or the like, as examples. Forming the top panel 102 from fabric (or essentially from fabric) allows the top panel 102 to collapse, for example, to allow the front panel 102 to move (e.g., toward the back panel 202), for instance, to reduce the interior volume of the apparatus 100.

The frame member 500 may be made of, include, or consist essentially of, stainless steel. Still further, in certain embodiments, the frame member 500 is made of, includes, or consists essentially of, coated steel, as another example. Even further, in various embodiments, the frame member 500 is made of, includes, or consists essentially of, wire, for example, spring wire, for instance containing bends (e.g., as described herein). In other embodiments, the frame member 500 is, includes, or consists essentially of: plastic (e.g., molded polypropylene, 3-D printed material, or tent pole material), fiber-reinforced plastic, fiberglass, carbon fiber, or carbon-fiber-reinforced plastic, as examples.

In various embodiments, the frame member 500 includes one or more (e.g., multiple) bends. For example, in a number of embodiments, the frame member 500 includes a right side bend 708(2), for example, at, or substantially at, an intersection of the right longitudinal member 704 side and the right base 706(2). In this context, "substantially at" means within ten percent of an overall dimension of the apparatus in the same direction. In particular embodiments, for example, the right side bend 708(2) is substantially a 90-degree bend. As used herein, when referring to angles or planes, "substantially" means to within 10 degrees. Further, in some embodiments, the frame member 500 includes a left side bend 708(1). For example, in certain embodiments, the left side bend 708(1) is at, or substantially at, an intersection of the left longitudinal member 702 and the left base 706(1). Still further, in particular embodiments, the left side bend 708(1) is substantially a 90-degree bend. Even further, in various embodiments, the right side bend and the left side bend are in a substantially common plane, have substantially equal angles of bend, or both.

Further, in some embodiments, the frame member includes a foot portion 502, for example, suitable to balance or counterbalance and support the apparatus 100. In a number of embodiments, for example, the foot portion 502 is formed in the frame member 500, specifically in the transverse base 706, for example.

In various embodiments, the frame member 500, for example, includes a radius of curvature R forming a left, right arc, for instance, in the left, right longitudinal member 702, 704. For example, in particular embodiments, the right arc has an angle of bend between 30 and 80 degrees. The radius of curvature may vary over the length of the left, right longitudinal members 702, 704. The left and right arcs are substantially coplanar with the left and right side panels 204, 106. Even further, in various embodiments, the left and right side panels 204, 106 include fabric, for example, two layers (or plies) of fabric. In some embodiments, the left, right longitudinal members 702, 704 of the frame member 500 are located between the two plies of fabric or within a right sleeve in the left or right side panels 204, 106. In some embodiments, the sleeves are formed by sewing the fabric. The sleeves are curved to match the arcs.

In some embodiments, the apparatus 100 includes (e.g., two) shoulder straps 802, for example, for carrying the apparatus 100 on a user's back. Further, in particular embodiments, the apparatus 100 or the front panel 104 of the apparatus 100 includes a shoulder strap compartment 808, possibly secured by first closure device 112, in which the shoulder straps are stored when not in use, and possibly stitched or coupled to an inside of the shoulder strap compartment 808. In a number of embodiments, the shoulder strap compartment 808 can also be used to carry items (i.e., other items besides the shoulder straps 802), for example, items like papers or a book to read while traveling. The shoulder straps 802, in a number of embodiments, may be connected to connection point 804, which may be a loop, a web of material, a snap, a buckle and tab, or other equally well known types of connectors. In some embodiments, the two exterior connection points 804 are located at or substantially at: an intersection of the front panel 104 and the bottom panel 503; an intersection of the front panel 104 and the right side panel 106, and an intersection of the front panel 104 and the left side panel 204; or some combination thereof.

In various embodiments, the apparatus or the bottom includes a (e.g., substantially rigid) folding bottom board 602 as explained above. The folding bottom board 602 is attached with a fabric hinge 604 in this exemplary embodiment. Other hinge connections are possible such as, for example, a piano hinge or the like. The fabric hinge 604, or other hinge, is a means for folding the folding bottom board 602. Generally, a fabric hinge means that bending of the fabric provides the rotation or pivoting of the hinge rather than rotation around a pin or axle. Still further, in a number of embodiments, the (e.g., substantially rigid) folding bottom board stiffens the bottom panel when the apparatus is being used. The (e.g., substantially rigid) folding bottom board 602 stiffens the bottom panel 503, in part, when the frame member 500 is expanded (e.g., away from the back panel 202). Folding the folding bottom board 602 allows the bottom panel 503 to collapse, at least in part, to allow the front panel 104 to move toward the back panel 503, which reduces the interior volume of the apparatus 100. The apparatus 100 includes the first releasable hook & loop fastener 606 that attaches the folding bottom board 602 to (e.g., a remainder of) the bottom panel 503 in an unfolded condition and is released (or the hook ply is separated from the loop ply) to allow the folding bottom board 602 to be folded away from the bottom panel 503, which allows the front panel 104 to collapse toward the back panel 202. The first releasable hook and loop fastener 606 is, includes, or consists essentially of, a hook and loop fastener (e.g., Velcro®) for example. Other embodiments, however, may use a different type of releasable fastener, such as one or more snaps, buttons, zippers, or a combination of all the above or other known releasable fasteners.

In a number of embodiments, the frame member 500 is in compression and pushes the front panel 104 away from the back panel 202. In other words, the frame member 500 may act as a spring. Still further, in various embodiments, the apparatus is a piece of luggage, for example, a piece of carry-on luggage.

Other embodiments include an apparatus or method of obtaining or providing an apparatus or information, for instance, that includes a novel combination of the features described herein. Even further embodiments include at least one means for accomplishing at least one functional aspect described herein. The subject matter described herein includes various means for accomplishing the various functions or acts described herein or that are apparent from the structure and acts described. Each function described herein is also contemplated as a means for accomplishing that function, or where appropriate, as a step for accomplishing that function. Moreover, various embodiments include certain (e.g., combinations of) aspects described herein. All novel combinations are potential embodiments. Some embodiments may include a subset of elements described herein, and various embodiments include additional elements as well. Various methods include various combinations of acts described herein. All feasible combinations are contemplated.

Further, various embodiments of the subject matter described herein include various combinations of the acts, structure, components, and features described herein, shown in the figures, described in any documents that are incorporated by reference herein, or that are known in the art. Moreover, certain procedures can include acts such as manufacturing, obtaining, or providing components that perform functions described herein or in the documents that are incorporated by reference. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

EXAMPLES

1. An apparatus for carrying items, the apparatus comprising:
   a back;
   a front;
   a bottom;
   a right side;
   a left side; and
   a frame member;
   wherein:
   the frame member collapses toward the back to allow the front to collapse toward the back to reduce a volume of the apparatus for shipping or storage; and
   the frame member expands away from the back to increase the volume of the apparatus when the apparatus is being used for carrying the items.
2. The apparatus of any of the preceding examples wherein the frame member extends across the left side.
3. The apparatus of any of the preceding examples wherein the frame member extends along the bottom.
4. The apparatus of any of the preceding examples wherein the frame member extends across the right side.
5. An apparatus for carrying items, the apparatus comprising:
   a back;
   a front;
   a bottom;
   a right side;
   a left side; and
   a frame member that extends:
   across the left side;
   along the bottom; and
   across the right side.
6. An apparatus for carrying items, the apparatus comprising:
   a back;
   a front;
   a bottom;
   a right side;
   a left side; and
   a frame member that extends:
   across the left side;
   substantially from the left side to the right side; and
   across the right side.
7. An apparatus for carrying items, the apparatus comprising:
   a back;
   a front;
   a bottom comprising a substantially rigid folding bottom board that is attached to
   a remainder of the bottom with a fabric hinge;
   a right side; and
   a left side.
8. The apparatus of the previous example further comprising a frame member.
9. The apparatus of any of the preceding examples having a frame member wherein the frame member extends substantially from the back to the front.
10. The apparatus of any of the preceding examples having a frame member wherein the frame member extends across the left side substantially from the back to the front.
11. The apparatus of any of the preceding examples having a frame member wherein the frame member extends across the right side substantially from the back to the front.
12. The apparatus of any of the preceding examples having a frame member wherein the frame member extends substantially from the left side to the right side along the bottom.

13. The apparatus of any of the preceding examples having a frame member wherein the frame member extends from the left side to the right side.
14. The apparatus of any of the preceding examples wherein the front is substantially opposite the back.
15. The apparatus of any of the preceding examples wherein the bottom extends from the back to the front.
16. The apparatus of any of the preceding examples wherein the right side extends from the back to the front.
17. The apparatus of any of the preceding examples wherein the right side extends to the bottom.
18. The apparatus of any of the preceding examples wherein the left side extends from the back to the front.
19. The apparatus of any of the preceding examples wherein the left side extends to the bottom.
20. The apparatus of any of the preceding examples having a frame member wherein the frame member collapses toward the back at the bottom to allow the front to collapse toward the back to reduce the volume of the apparatus for shipping or storage.
21. The apparatus of any of the preceding examples having a frame member wherein the frame member expands away from the back at the bottom to increase the volume of the apparatus when the apparatus is being used for carrying the items.
22. An apparatus for carrying items, the apparatus comprising:
    a back;
    a front substantially opposite the back;
    a bottom that extends from the back to the front;
    a right side that extends from the back to the front and that extends to the bottom;
    a left side that extends from the back to the front and that extends to the bottom, wherein the left side is substantially opposite the right side;
    a frame member that extends:
        across the left side substantially from the back to the front;
        along the bottom substantially from the left side to the right side; and
        across the right side substantially from the front to the back;
    wherein:
        the frame member collapses toward the back at the bottom to allow the front to collapse toward the back to reduce a volume of the apparatus for shipping or storage; and
        the frame member expands away from the back to increase the volume of the apparatus when the apparatus is being used for carrying the items.
23. The apparatus of any of the preceding examples further comprising a top.
24. The apparatus of any of the preceding examples that include a top wherein the top extends from the back to the front.
25. The apparatus of any of the preceding examples that include a top wherein the top extends from the right side to the left side.
26. The apparatus of any of the preceding examples that include a top wherein the top is substantially opposite the bottom.
27. The apparatus of any of the preceding examples that include a top wherein the top comprises fabric.
28. The apparatus of any of the preceding examples that include a top wherein the top consists essentially of fabric.
29. The apparatus of any of the preceding examples that include a top wherein the top collapses to allow the front to move toward the back to reduce the volume of the apparatus for shipping or storage.
30. The apparatus of any of the preceding examples that include the top wherein the top comprises a top handle for lifting the apparatus.
31. The apparatus of any of the preceding examples that include the top wherein the top comprises a compartment for storage of small items.
32. The apparatus of any of the preceding examples that include the top wherein the top comprises a zippered compartment for storage of small items.
33. The apparatus of any of the preceding examples that include the top wherein the top comprises a fabric compartment for storage of small items.
34. The apparatus of any of the preceding examples further comprising a zipper in the front that unzips to allow the items to be placed in the apparatus and that zips to hold the items within the apparatus.
35. The apparatus of any of the preceding examples further comprising a zipper that: connects the front to the right side; and connects the front to the left side.
36. The apparatus of the preceding example wherein the zipper further connects the front to the bottom.
37. The apparatus of any of the preceding examples further comprising a telescoping handle that: collapses into the back; and expands opposite the bottom.
38. The apparatus of any of the preceding examples further comprising two wheels mounted substantially at an intersection of the back and the bottom.
39. The apparatus of any of the preceding examples further comprising a substantially rigid member substantially at an intersection of the back and the bottom.
40. The apparatus of any preceding examples having a substantially rigid member wherein two wheels are mounted in the substantially rigid member.
41. The apparatus of any preceding examples having a substantially rigid member wherein the substantially rigid member is curved.
42. The apparatus of any preceding examples having a substantially rigid member wherein the substantially rigid member is curved substantially from a plane of the back to a plane of the bottom.
43. The apparatus of any preceding examples having a substantially rigid member wherein the substantially rigid member is plastic.
44. The apparatus of any preceding examples having a substantially rigid member wherein the substantially rigid member extends part way across the bottom from the back toward the front.
45. The apparatus of any preceding examples having a frame member and a substantially rigid member wherein, when the frame member is fully expanded away from the back for the apparatus to be used for carrying the items, the substantially rigid member extends from the back at least one third of a distance across the bottom from the back to the front.
46. The apparatus of any preceding examples having a frame member and a substantially rigid member wherein, when the frame member is fully expanded away from the back for the apparatus to be used for carrying the items, the substantially rigid member extends from the back no more than two thirds of a distance across the bottom from the back to the front.
47. The apparatus of any preceding examples having a frame member and a substantially rigid member wherein, when the frame member is fully expanded away from the back for the apparatus to be used for carrying the items, the substantially rigid member extends from the back about half of a distance across the bottom from the back to the front.

48. The apparatus of any preceding examples having a substantially rigid member wherein the substantially rigid member extends part way up the back from the bottom.

49. The apparatus of any preceding examples having a substantially rigid member wherein the substantially rigid member extends up the back from the bottom less than 25 percent of a height of the back.

50. The apparatus of any preceding examples having a substantially rigid member wherein the substantially rigid member extends up the back from the bottom more than 10 percent of a height of the back.

51. The apparatus of any preceding examples having a frame member and two wheels wherein, when the frame member is expanded away from the back to increase the volume of the apparatus for carrying the items, the apparatus balances on the two wheels and the frame member on a flat level surface with the back substantially vertical.

52. The apparatus of any of the preceding examples having a frame member wherein the frame member is monolithic.

53. The apparatus of any of the preceding examples having a frame member wherein the frame member has a solid cross section.

54. The apparatus of any of the preceding examples having a frame member wherein the frame member has a substantially round cross section.

55. The apparatus of any of the preceding examples having a frame member wherein the frame member comprises steel.

56. The apparatus of any of the preceding examples having a frame member wherein the frame member comprises stainless steel.

57. The apparatus of any of the preceding examples having a frame member wherein the frame member is steel.

58. The apparatus of any of the preceding examples having a frame member wherein the frame member consists essentially of stainless steel.

59. The apparatus of any of the preceding examples having a frame member wherein the frame member consists essentially of coated steel.

60. The apparatus of any of the preceding examples having a frame member wherein the frame member comprises bent wire.

61. The apparatus of any of the preceding examples having a frame member wherein the frame member consists essentially of bent wire.

62. The apparatus of any of the preceding examples having a frame member wherein the frame member comprises a right side bend.

63. The apparatus of the preceding example having a frame member wherein the right side bend is at an intersection of the right side and the bottom.

64. The apparatus of any of the preceding examples having a right side bend wherein the right side bend is substantially a 90-degree bend.

65. The apparatus of any of the preceding examples having a frame member wherein the frame member comprises a left side bend.

66. The apparatus of the preceding example wherein the left side bend is at an intersection of the left side and the bottom.

67. The apparatus of any of the preceding examples having a left side bend wherein the left side bend is substantially a 90-degree bend.

68. The apparatus of any of the preceding examples that include the right side bend and the left side bend wherein the right side bend and the left side bend are in a substantially common plane.

69. The apparatus of any of the preceding examples having a frame member, the frame member further comprising multiple bottom bends substantially at the bottom of the apparatus.

70. The apparatus of any of the preceding examples having a frame member, the frame member further comprising four bottom bends.

71. The apparatus of any of the preceding examples having a frame member that includes the right side bend and the left side bend wherein the frame member further comprises bottom bends between the right side bend and the left side bend.

72. The apparatus of any of the preceding examples having a frame member that includes bottom bends wherein the bottom bends each have a substantially common angle of bend.

73. The apparatus of any of the preceding examples having a frame member that includes bottom bends wherein the bottom bends each have a substantially 45-degree angle of bend.

74. The apparatus of any of the preceding examples having a frame member that includes bottom bends wherein the bottom bends are each in a substantially common plane.

75. The apparatus of any of the preceding examples that include a frame member wherein the frame member comprises a handle suitable for lifting the apparatus when the apparatus is placed on the back on a flat level surface.

76. The apparatus of any of the preceding examples having a frame member that includes bottom bends wherein the bottom bends form a handle in the frame member suitable for lifting the apparatus when the apparatus is placed on the back on a flat level surface.

77. The apparatus of any of the preceding examples that include a frame member wherein the frame member includes a foot suitable to balance and support the apparatus when the apparatus is placed on a flat level surface with the back substantially vertical.

78. The apparatus of any of the preceding examples that include two wheels and having a frame member with bottom bends wherein the bottom bends form a foot in the frame member suitable to balance and support the apparatus when the apparatus is placed on the foot and the two wheels on a flat level surface with the back substantially vertical.

79. The apparatus of any of the preceding examples having a foot and a frame member that includes a handle in the frame member wherein the handle is also the foot.

80. The apparatus of any of the preceding examples having a frame member wherein the frame member comprises a right arc at the right side.

81. The apparatus of any of the preceding examples that include the right arc wherein the right arc has an angle of bend between 30 and 80 degrees.

82. The apparatus of any of the preceding examples having a frame member that includes the right side bend and the right arc wherein the right arc has a radius of curvature that is at least ten times a radius of curvature of the right side bend.

83. The apparatus of any of the preceding examples that include the right arc wherein the right arc is substantially coplanar with the right side.

84. The apparatus of any of the preceding examples wherein the right side comprises fabric.

85. The apparatus of any of the preceding examples wherein the right side comprises two layers of fabric.
86. The apparatus of any of the preceding examples having a frame member wherein the right side consists essentially of fabric and part of the frame member.
87. The apparatus of any of the preceding examples having a frame member wherein part of the frame member is located within a right sleeve in the right side.
88. The apparatus of the preceding example wherein the right sleeve is sewn into the right side.
89. The apparatus of any of the preceding examples having a frame member wherein the frame member comprises a right terminal end at the right side.
90. The apparatus of the preceding example wherein the right terminal end at the right side comprises a right terminal bend in the frame member.
91. The apparatus of the preceding examples wherein the right terminal bend in the frame member has a bend angle of at least 170 degrees.
92. The apparatus of any of the preceding examples having a frame member wherein the frame member comprises a left arc at the left side.
93. The apparatus of any of the preceding examples that include the left arc wherein the left arc has an angle of bend between 30 and 80 degrees.
94. The apparatus of any of the preceding examples having a frame member that includes the left side bend and the left arc wherein the left arc has a radius of curvature that is at least ten times a radius of curvature of the left side bend.
95. The apparatus of any of the preceding examples that include the left arc wherein the left arc is substantially coplanar with the left side.
96. The apparatus of any of the preceding examples wherein the left side comprises fabric.
97. The apparatus of any of the preceding examples wherein the left side comprises two layers of fabric.
98. The apparatus of any of the preceding examples having a frame member wherein the left side consists essentially of fabric and part of the frame member.
99. The apparatus of any of the preceding examples having a frame member wherein part of the frame member is located within a left sleeve in the left side.
100. The apparatus of the preceding example wherein the left sleeve is sewn into the left side.
101. The apparatus of any of the preceding examples having a frame member wherein the frame member comprises a left terminal end at the left side.
102. The apparatus of the preceding claim wherein the left terminal end at the left side comprises a left terminal bend in the frame member.
103. The apparatus of the preceding example wherein the left terminal bend in the frame member has a bend angle of at least 170 degrees.
104. The apparatus of any of the preceding examples wherein the left side is substantially parallel to the right side.
105. The apparatus of any of the preceding examples further comprising two shoulder straps for carrying the apparatus on a user's back.
106. The apparatus of the preceding example wherein: the front includes a compartment; the two shoulder straps are connected to the front within the compartment; and the apparatus is configured for the two shoulder straps to be stored within the compartment when the two shoulder straps are not being used for carrying the apparatus on the user's back.
107. The apparatus of the preceding example wherein the compartment is a zippered compartment.
108. The apparatus of any of the preceding examples wherein the apparatus is configured for the two shoulder straps to be removed from the compartment and connected to two exterior connection points on the apparatus when the two shoulder straps are being used for carrying the apparatus on the user's back.
109. The apparatus of the preceding example wherein the two exterior connection points are located substantially at an intersection of the front and the bottom.
110. The apparatus of any of the preceding examples having two exterior connection points wherein the two exterior connection points are located substantially at intersections of the front and the right side, and the front and the left side.
111. The apparatus of any of the preceding examples having two exterior connection points wherein the two exterior connection points are located substantially at intersections of the bottom and the right side, and the bottom and the left side.
112. The apparatus of any of the preceding examples having two exterior connection points wherein the two exterior connection points each comprise a loop of webbing.
113. The apparatus of any of the preceding examples wherein the bottom includes a substantially rigid folding bottom board.
114. The apparatus of any of the preceding examples having a substantially rigid folding bottom board wherein the substantially rigid folding bottom board is attached to a remainder of the bottom with a hinge.
115. The apparatus of any of the preceding examples having a hinge wherein the hinge is a fabric hinge.
116. The apparatus of any of the preceding example having a substantially rigid folding bottom board wherein the substantially rigid folding bottom board stiffens the bottom when the apparatus is being used for carrying the items.
117. The apparatus of any of the preceding examples having a frame member and a substantially rigid folding bottom board wherein the substantially rigid folding bottom board stiffens the bottom when the frame member is expanded away from the back.
118. The apparatus of any of the preceding examples having a substantially rigid folding bottom board wherein the substantially rigid folding bottom board pivots to allow the bottom to collapse to allow the front to move toward the back to reduce volume of the apparatus for shipping and storage.
119. The apparatus of any of the preceding examples further comprising a releasable fastener.
120. The apparatus of the preceding example wherein the bottom comprises the releasable fastener.
121. The apparatus of any of the preceding examples having a substantially rigid folding bottom board and a releasable fastener wherein the releasable fastener attaches the folding bottom board to a remainder of the apparatus.
122. The apparatus of any of the preceding examples having a substantially rigid folding bottom board and a releasable fastener wherein the releasable fastener attaches the folding bottom board to a remainder of the bottom.
123. The apparatus of any of the preceding examples having a releasable fastener wherein the releasable fastener stiffens the bottom when the apparatus is being used for carrying the items.
124. The apparatus of any of the preceding examples that include a substantially rigid folding bottom board and a releasable fastener wherein the releasable fastener attaches the folding bottom board to stiffen the bottom when the apparatus is being used for carrying the items.

125. The apparatus of any preceding examples having a substantially rigid member and a substantially rigid folding bottom board wherein the substantially rigid folding bottom board is attached to the substantially rigid member.

126. The apparatus of any of the preceding examples that include a releasable fastener wherein the releasable fastener releases to allow the bottom to collapse to allow the front to move toward the back to reduce volume of the apparatus for shipping and storage.

127. The apparatus of any of the preceding examples that include the releasable fastener wherein the releasable fastener comprises a hook and loop fastener.

128. The apparatus of any of the preceding examples that include the frame member wherein the frame member pushes the front away from the back to increase a volume of the apparatus.

129. The apparatus of any of the preceding examples that include the frame member wherein the frame member pushes the front away from the back at the bottom of the apparatus.

130. The apparatus of any of the preceding examples that include the frame member wherein the frame member expands the bottom to increase the volume of the apparatus.

131. The apparatus of any of the preceding examples that include the frame member wherein the frame member acts as a spring to push the front away from the back.

132. The apparatus of any of the preceding examples wherein the apparatus is a piece of luggage.

133. The apparatus of any of the preceding examples wherein the apparatus is a piece of carry-on luggage.

The invention claimed is:

1. An apparatus for carrying items, comprising:

a back panel;

a front panel;

a bottom panel;

a top panel;

a right side panel;

a left side panel, wherein the back panel, front panel, bottom panel, right side panel, and left side panel are coupled to define an interior volume; and a frame member operatively coupled to the back panel, front panel, bottom panel, right side panel, and left side panel, the frame member comprising a left longitudinal arm extending lengthwise along the left side panel, and a right longitudinal arm extending along the right side panel, wherein the left longitudinal arm and the right longitudinal arm extend from an intersection of the front panel and the bottom panel to an intersection of the top panel and the back panel in an arc having a plurality of radii of curvature that decrease from the bottom panel toward the top panel;

wherein:

the frame member allows the front panel to collapse toward the back panel to reduce the interior volume; and the frame member expands the front panel from the back panel to increase the interior volume of the apparatus.

2. The apparatus of claim 1 wherein the bottom panel in part comprises a substantially rigid folding bottom board that is attached to a remainder of the bottom panel with a fabric hinge, wherein folding the bottom board allows the frame member to collapse from the front panel toward the back panel.

3. The apparatus of claim 1 wherein the frame member comprises a transverse base extending from the left side panel to the right side panel interconnecting the left and right longitudinal arms.

4. The apparatus of claim 3 wherein the transverse base has a descending foot portion.

5. The apparatus of claim 4 wherein the descending foot portion has a plurality of bends to form a foot.

6. An apparatus comprising:

a back panel;

a front panel substantially opposite the back panel;

a bottom panel that extends from the back panel to the front panel, the bottom panel comprising a folding bottom board that is coupled to the bottom panel by a hinge, the folding bottom board having an unfolded position where the folding bottom board is proximal an intersection of the front panel and the bottom panel, and a folded position where the folding bottom board is folded about the hinge and distal the intersection of the front panel and the bottom panel;

a right side panel that extends from the back panel to the front panel;

a left side panel that extends from the back panel to the front panel, wherein the left side panel is substantially opposite the right side panel;

a frame member comprising a left longitudinal arm that extends across the left side panel substantially from the back panel to the front panel; a right longitudinal arm that extends across the right side panel substantially from the back panel to the front panel; and a transverse base that extends from the left side panel to the right side panel along the intersection of the front panel and the bottom panel;

wherein:

the transverse base collapses toward the back panel when the folding bottom board is in the folded position.

7. The apparatus of claim 6 wherein the hinge is a fabric hinge.

8. The apparatus of claim 6 wherein the transverse base comprises a foot portion.

9. The apparatus of claim 6 wherein the transverse base comprises a left portion, a right portion, and a descending foot portion between the left portion and the right portion.

10. The apparatus of claim 9 wherein the descending foot portion is formed by a plurality of bends.

11. The apparatus of claim 6 wherein the left and right longitudinal arms have a plurality of radii of curvature.

12. The apparatus of claim 11 wherein the frame member is biased such that the transverse base moves toward the front panel.

13. The apparatus of claim 6 further comprising a cam strap wherein the cam strap holds the apparatus in a collapsed state.

14. The apparatus of claim 6 wherein the foldable bottom panel is maintained in the unfolded position by a fastener operatively coupling the foldable bottom panel and the bottom panel.

15. The apparatus of claim 14 wherein the fastener comprises a hook and loop fastener.

16. The apparatus of claim 15 wherein a first ply of the hook and loop fastener is on the foldable bottom panel and a second ply of the hook and loop fastener is on the bottom panel.

* * * * *